US006012236A

United States Patent [19]

Pozzobon

[11] Patent Number: 6,012,236

[45] Date of Patent: Jan. 11, 2000

[54] INNERBOOT PARTICULARLY FOR SPORTS SHOES

[75] Inventor: Alessandro Pozzobon, Paderno di Ponzano Veneto, Italy

[73] Assignee: Nordica S.p.A., Trevignano, Italy

[21] Appl. No.: 08/820,628

[22] Filed: Mar. 19, 1997

[30] Foreign Application Priority Data

Apr. 11, 1996 [IT] Italy ..... TV96A0049

[51] Int. Cl.[7] ..... A43B 23/07; A43B 7/06

[52] U.S. Cl. ..... 36/55; 36/3 R; 36/3 A; 36/93

[58] Field of Search ..... 36/3 R, 3 A, 10, 36/55, 88, 93

[56] References Cited

U.S. PATENT DOCUMENTS

| | | | |
|---|---|---|---|
| 2,651,854 | 9/1953 | Taber et al. | 36/3 A |
| 2,869,253 | 1/1959 | Sachs | 36/55 |
| 4,837,884 | 6/1989 | Hilgarth | 36/93 |
| 5,339,545 | 8/1994 | Paris | 36/55 |
| 5,528,841 | 6/1996 | Pozzobon | 36/3 A |
| 5,738,937 | 4/1998 | Baychar | 36/55 |
| 5,746,015 | 5/1998 | Clement et al. | 36/93 |

FOREIGN PATENT DOCUMENTS

| | | |
|---|---|---|
| 0 177 892 | 4/1986 | European Pat. Off. . |
| 0 568 825 | 11/1993 | European Pat. Off. . |
| 2 336 892 | 7/1977 | France . |
| 2 594 304 | 8/1987 | France . |
| 9 406 317 | 3/1994 | WIPO . |

*Primary Examiner*—M. D. Patterson
*Attorney, Agent, or Firm*—Guido Modiano; Albert Josif

[57] ABSTRACT

An innerboot, particularly for sports shoes, made of thermoformable material, includes, at its inner lateral surface, one or more channels advantageously connected to the outside through one or more holes, the innerboot allowing ventilation of the foot arranged inside the innerboot, improving user comfort.

21 Claims, 2 Drawing Sheets

INNERBOOT PARTICULARLY FOR SPORTS SHOES

BACKGROUND OF THIE INVENTION

The present invention relates to an innerboot, particularly for sports shoes, made of thermoformable material.

Sports shoes, such as for example ski boots or roller skates or ice skates, are currently conventionally provided with an external structure, constituted by a shell and optionally by one or more quarters articulated thereto, which are made of rigid material. In order to increase the user's comfort, an innerboot made of soft material is usually inserted in the shell and in the quarters.

Said innerboots are conventionally produced by using thermoformable materials having a closed-cell structure and therefore being not vapor-permeable and the characteristic whereof is that they adapt very well, when heated appropriately, to the anatomy of the user's foot, offering both better comfort during sports practice and a good degree of foot securing, so as to transmit the efforts to the ski, to the wheels, or to the ice-skating blade in an optimum manner.

Said conventional innerboots, however, entail drawbacks: since the thermoformable material is not vapor-permeable, the foot sweats during the use of the sports shoe and it is not possible to expel the resulting moisture externally, thus considerably reducing user comfort.

Any provision of through holes at the walls of the innerboot would still not solve the problem, because ventilation would occur in any case only at the perforated regions, whilst the moisture would stagnate in the remaining regions.

Moreover, through holes cannot be provided extensively in the innerboot, because they would weaken it.

Moreover, during shaping, the deformation of the innerboot after heating would plug the holes, making them useless for their purpose.

U.S. Pat. No. 4,095,355 discloses an inshoe for a ski boot having, at the lateral surfaces and in a region adjacent to the malleoli, a plurality of projections adapted to produce air circulation between the inner lateral surface of the boot, which is rigid, and the outer lateral surface of the inshoe, which is soft.

This solution has been provided specifically with the purpose of varying the inshoe softness in some particular regions, such as for example the malleolar region.

Said projections should also allow a different transmission of forces from the foot to the boot and therefore to the ski according to the different deformation of the projections.

Said patent also mentions the possibility of providing the projections at the inner lateral surface of the inshoe so that said projections make contact with the user's foot.

However, this possibility, which is not shown, has drawbacks: by providing ventilation during the movement of the foot, which by compressing the projections produces a "pump effect" affecting small air pockets that form during this very movement, the relative movements of the foot with respect to the inshoe or of the inshoe with respect to the boot are observed to increase, and this is in contrast with current trends which tend to provide for optimum securing of the foot in order to achieve more direct and better control of the sports implement, such as the ski.

Moreover, the fastening of the shell and/or of the quarters of the boot certainly limits this "pump effect", because an undesired precompression of the projections would occur, thus limiting any compression of the small air pockets that form during the movement of the foot.

SUMMARY OF THE INVENTION

A principal aim of the present invention is to solve the described problems, eliminating the drawbacks of the cited prior art by providing an innerboot, particularly for sports shoes and made of thermoformable material, which allows to achieve optimum ventilation of the foot and satisfactory comfort thereof.

Within the scope of this aim, an important object is to provide an innerboot wherein the fastening degree of the sports shoe does not affect the ventilation of the foot.

Another important object is to provide an innerboot which, while allowing optimum foot ventilation, does not cause undesired relative movements of said innerboot inside the sports shoe.

Another object is to provide an innerboot which associates with the above-described characteristics that of allowing perfect securing of the foot inside said innerboot, and which can be produced with conventional machines and equipment.

This aim, these objects, and others which will become apparent hereinafter are achieved by an innerboot, particularly for sports shoes, made of thermoformable material and characterized in that it comprises an outer lining, associated with a first layer of thermoformable material having one or more first holes, and a second layer of transpiring material, one or more channels being formed at said second layer.

Advantageously, said one or more channels are connected to the outside of the innerboot through one or more adapted second holes.

BRIEF DESCRIPTION OF THE DRAWINGS

Further characteristics and advantages of the invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 2:
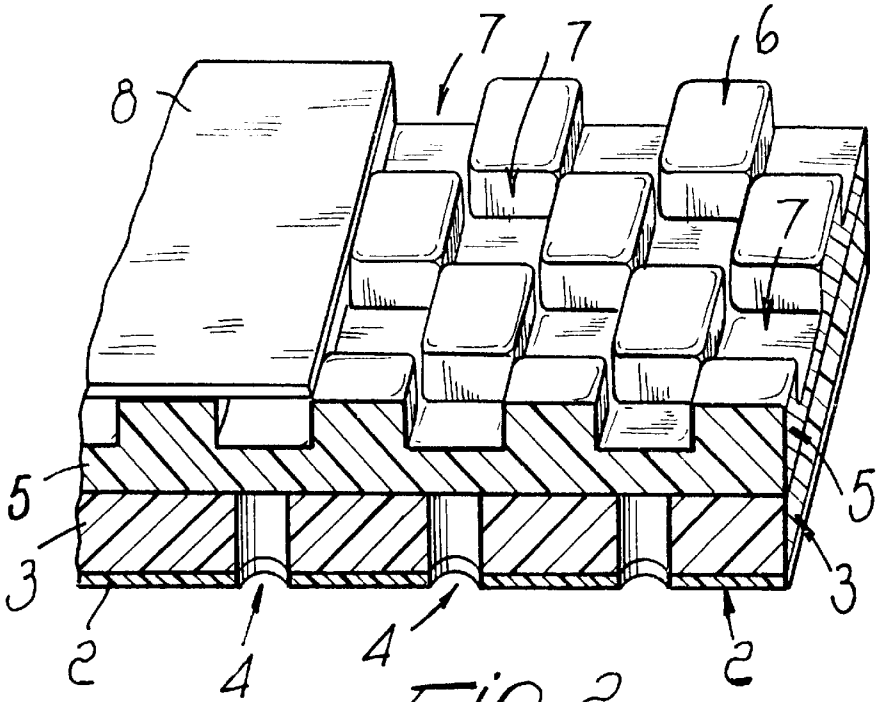
FIG. 2 is a sectional perspective view of the innerboot.
Figure 1:
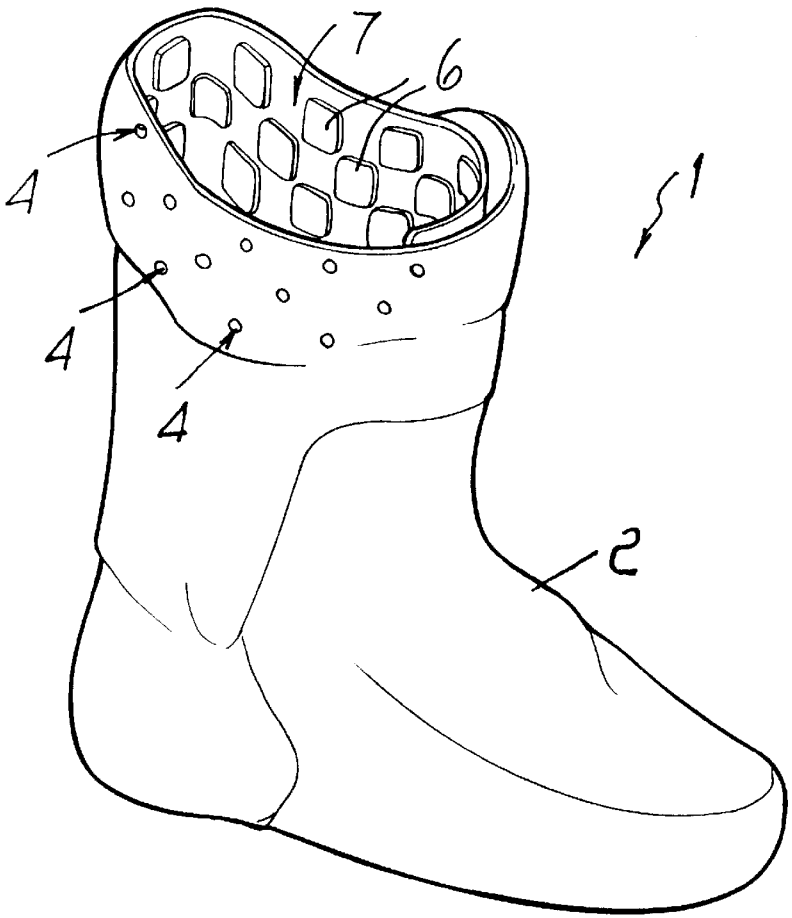
FIG. 1 is a perspective view of an innerboot.

With reference to the above figures, the reference numeral 1 designates the innerboot of the type particularly usable for sports shoes, such as ski boots or roller skates or ice skates.

The innerboot comprises an outer lining 2 which is coupled to a first layer 3 of thermoformable material whereon one or more adapted first holes 4 are advantageously formed in a selected region of the innerboot and may pass through the outer lining 2.

Figure 4:
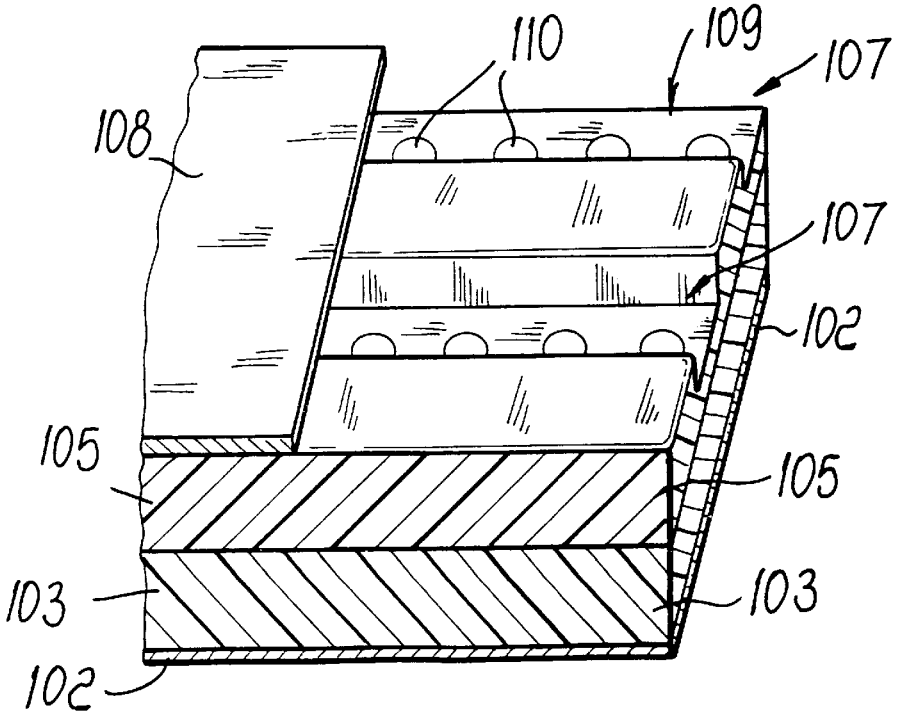

A second layer or film 5 of vapor-permeable material is coupled to the first layer 3 and has, at the surface 6 directed towards the inside of the innerboot 1, an adapted shape suitable to form one or more channels 7 arranged for example in a labyrinth-shaped configuration, as shown in FIG. 2, or along a selected direction, as shown in FIG. 4.

The second layer 5 can advantageously deform, while maintaining the presence of channels 7, and adapt to the anatomical configuration of the foot according to the deformations undergone by the layer of thermoformable material 3 during the thermoformation process.

Preferably, the coupling between the first layer 3 and the second layer 5 is provided on sheets of the respective materials according to conventional technologies and methods, obtaining a sandwich to be used in the subsequent production of the innerboot. This allows to perform thermoformation after the insertion of the foot in the sports shoe and, thanks to a preset thickness of the second layer 5, the second layer can follow the deformations of the first thermoformable layer 3, while keeping the channels 7, during said thermoformation step.

This solution therefore allows to maintain a plurality of channels optionally even at the entire inner surface of the innerboot. Thus the moisture may flow out through the channels and discharge externally through the first through holes 4 formed on the first layer 3 and optionally on the outer lining 2.

The innerboot also allows to achieve optimum foot securing through the optimum adaptability of the second layer 5 to the foot and through the configuration assumed by the first layer 3 with respect to the internal structure of the sports shoe during thermoformation.

In order to increase the user's comfort, an inner lining 8 may be associated with the surface 6 of the second layer 5 facing the inside of the innerboot.

The innerboot thus conceived is of course susceptible of numerous modifications and variations, within the scope of the appended claims.

Figure 3:
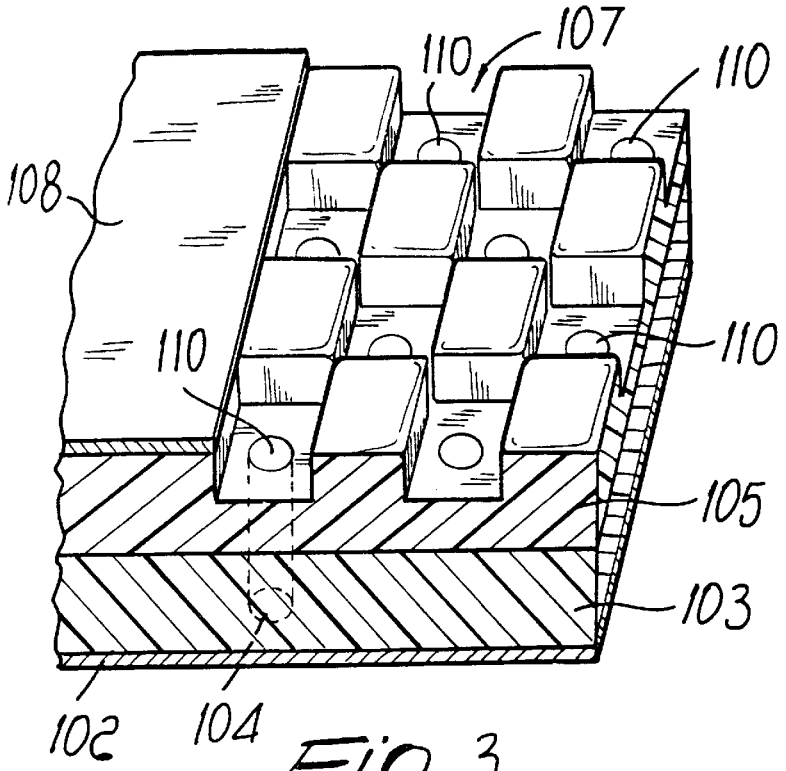
FIGS. 3 and 4 are sectional views, similar to FIG. 2, of respectively two further embodiments of the innerboot according to the invention.

Thus, for example, FIGS. 3 and 4 illustrate an innerboot constituted by the coupling of an outer lining 102 and of a first layer 103 of thermoformable material provided with first through holes 104 which optionally also pass through the outer lining 102.

A second layer or film 105 of non-transpiring material is coupled to the first layer 103, and one or more channels 107 are provided on said layer or film and have a labyrinth configuration, as shown in FIG. 3, or are arranged according to preferred directions, as shown in FIG. 4.

Use of a second layer 105 of non-transpiring material provides for the formation, at the base surface 109 and at the channels 107, of one or more adapted second holes 110 allowing moisture to flow out. This solution, too, allows to achieve the intended aim and objects if both the first and the second layers are made of thermoformable material, which is notoriously not vapor-permeable.

The above-described embodiment can also be used if a transpiring or vapor-permeable material is used for the second layer 105: in this manner, ventilation and outflow of the moisture will be increased.

The dimensions constituting the individual components of the innerboot, such as for example the configuration, size, and number of the channels and of the first and second holes, may of course be the most pertinent according to specific requirements.

What is claimed is:

1. An innerboot for insertion inside an outer shell of a sports shoe, the innerboot having an inside surface for arrangement adjacent a user's foot and an outside surface for arrangement adjacent an inside surface of the outer shell of the sports shoe when the innerboot is inserted inside the outer shell of the sports shoe, the innerboot comprising:

a first layer of thermoformable material;

one or more first holes extending through said first layer of thermoformable material;

a second layer connected with said first layer, and said second layer being vapour permeable such that vapour may pass through said first holes of said first layer and through said second layer; and one or more channels formed at said second layer at a surface of said second layer arranged opposite to said first layer;

said second layer being deformable sufficient to maintain a presence of said one or more channels upon said first layer of thermoformable material being deformed during a thermoformation process to adapt said first layer of thermoformable material to an anatomical configuration of a user's foot.

2. An innerboot according to claim 1, wherein said second layer is made of a non-transpiring material, one or more second holes being formed at said second layer and extending through said second layer such that said second layer is vapour permeable, said second holes being arranged in correspondence with said first holes.

3. An innerboot according to claim 2, wherein said one or more second holes, connected to said first holes, are formed on a base surface of said one or more channels formed on said second layer.

4. An innerboot according to claim 2, further comprising an outer lining connected to said first layer at a surface of said first layer arranged at said outside surface opposite to said second layer, and wherein said one or more first holes extend through said outer lining.

5. An innerboot according to claim 1, further comprising an outer lining connected to said first layer at a surface of said first layer arranged opposite to said second layer, and wherein said second layer is made of vapour-transpiring material such that said second layer is vapour permeable, and wherein said one or more first holes extend through said outer lining.

6. An innerboot according to claim 1, wherein said surface of said second layer forming said one or more channels is an inward-facing surface arranged adjacent the inside surface of the innerboot.

7. An innerboot according to claim 6, wherein said second layer has such a thickness as to allow foot insertion prior to said thermoformation process of said first layer of said innerboot.

8. An innerboot according to claim 4, wherein said first layer is arranged adjacent the outside surface of the innerboot.

9. An innerboot according to claim 8, further comprising an inner lining associated with said second layer.

10. An innerboot according to claim 8, further comprising an inner lining associated with said second layer.

11. An innerboot according to claim 1, wherein said one or more channels of said second layer are arranged in a labyrinth-shaped configuration at said inward-facing surface, and wherein said one or more channels extend only partially into said second layer.

12. An innerboot according to claim 1, wherein said one or more channels are arranged along linear directions at said inward-facing surface, and wherein said one or more channels extend only partially into said second layer.

13. An innerboot according to claim 12, wherein said one or more channels of said second layer are partially interconnected at said inward-facing surface.

14. An innerboot according to claim 12, wherein said one or more channels of said second layer are not interconnected at said inward-facing surface.

15. An innerboot according to claim 1, wherein said surface of second layer forming said one or more channels is an inward-facing surface arranged adjacent said inside surface of the innerboot.

16. An innerboot according to claim 15, wherein said second layer has a thickness sufficient to allow a user's foot to be inserted in the innerboot arranged inside the outer shell of the sports shoe prior to said thermoformation process of said first layer of said innerboot.

17. An innerboot according to claim 1, wherein said one or more channels of said second layer are arranged in a labyrinth-shaped configuration at said inward-facing surface, and wherein said one or more channels extend only partially into said second layer.

18. An innerboot according to claim 1, wherein said one or more channels are arranged along linear directions at said inward-facing surface, and wherein said one or more channels extend only partially into said second layer.

19. An innerboot according to claim 18, wherein said one or more channels of said second layer are partially interconnected at said inward-facing surface.

20. An innerboot according to claim 18, wherein said one or more channels of said second layer are not interconnected at said inward-facing surface.

21. An innerboot according to claim 1, wherein said first layer of thermoformable material is arranged adjacent said outside surface of said innerboot, and wherein said second layer is arranged adjacent said inside surface of said innerboot.

* * * * *